US012504207B2

(12) United States Patent
Hauleitner et al.

(10) Patent No.: US 12,504,207 B2
(45) Date of Patent: Dec. 23, 2025

(54) COOLING SYSTEM AND METHOD FOR OPERATING A COOLING SYSTEM

(71) Applicant: AKTIEBOLAGET SKF, Gothenburg (SE)

(72) Inventors: Rudolf Hauleitner, Ann Arbor, MI (US); Hans Wallin, Cape Coral, FL (US)

(73) Assignee: AKTIEBOLAGET SKF, Gothenburg (SE)

( * ) Notice: Subject to any disclaimer, the term of this patent is extended or adjusted under 35 U.S.C. 154(b) by 248 days.

(21) Appl. No.: 18/110,980

(22) Filed: Feb. 17, 2023

(65) Prior Publication Data

US 2024/0280300 A1 Aug. 22, 2024

(51) Int. Cl.

| | |
|---|---|
| ***F25B 31/00*** | (2006.01) |
| ***F25B 41/26*** | (2021.01) |
| ***F25B 49/00*** | (2006.01) |

(52) U.S. Cl.

CPC ..... *F25B 31/004* (2013.01); *F25B 41/26* (2021.01); *F25B 49/005* (2013.01); *F25B 2500/16* (2013.01)

(58) Field of Classification Search

CPC ..... F25B 31/004; F25B 41/26; F25B 49/005; F25B 2500/16; F25B 43/02; F25B 2400/23; F25B 31/002; F25B 31/008; F04C 29/026

USPC ..... 62/512, 470, 505

See application file for complete search history.

(56) References Cited

U.S. PATENT DOCUMENTS 6,131,471 A * 10/2000 Okoren ..... G01F 23/2922 340/619
11,435,122 B2 * 9/2022 Muller ..... F25B 31/004
2001/0037651 A1 * 11/2001 Butterworth ..... F04D 29/5806 62/468

FOREIGN PATENT DOCUMENTS

CN 112856859 A * 5/2021 ..... F16C 33/6637

OTHER PUBLICATIONS

English language translation of CN112856859 to Shang et al. Translated Feb. 2025 (Year: 2021).*

* cited by examiner

*Primary Examiner* — Cassey D Bauer
(74) *Attorney, Agent, or Firm* — J-TEK LAW PLLC; Scott T. Wakeman; Mark A. Ussai

(57) ABSTRACT

A cooling system includes a refrigerant cycle having a compressor unit for compressing gaseous refrigerant, a condenser unit for condensing gaseous refrigerant to liquid refrigerant, an optional economizer unit for reducing pressure of the refrigerant and partially evaporating the liquid refrigerant, and an evaporator unit for evaporating the liquid refrigerant to gaseous refrigerant. The refrigerant is cycled from the compressor unit to the condenser unit, from the condenser unit to evaporator unit, and back to the compressor unit. The compressor unit includes at least one bearing assembly and a lubrication cycle providing liquid refrigerant to lubricate the bearing assembly. The lubrication cycle has a lubricating refrigerant supply line, branched from the condenser unit or from the economizer unit to the bearing assembly, and connected to an injection device(s) for introducing lubricating refrigerant into the bearing assembly. A vapor separating unit separates gaseous lubricating refrigerant from liquid phase lubricating refrigerant.

20 Claims, 2 Drawing Sheets

COOLING SYSTEM AND METHOD FOR OPERATING A COOLING SYSTEM

BACKGROUND OF THE INVENTION

The present invention relates to cooling systems, and more particularly to cooling systems including refrigerant and devices for phase transitioning such refrigerant.

A cooling system, such as a chiller or air conditioning system, generally includes a compressor unit, a condenser unit, an expansion device and an evaporator unit, which are connected into a so-called cooling cycle or vapor compression refrigerant cycle. In the cooling cycle, refrigerant is cycled from at least the compressor unit for compressing gaseous refrigerant to the condenser for condensing gaseous refrigerant to liquid refrigerant, from the condenser unit to the expansion unit for expanding the liquid refrigerant, from the expansion unit to an evaporator unit for evaporating the liquid refrigerant to gaseous refrigerant, and from the evaporating unit back to the compressor unit. Usually, such a cooling system removes heat from a liquid via the vapor-compression refrigerant cycle. The cooled liquid may then be used to cool air (e.g., air conditioning) or in an industrial process.

The compressor unit itself may be a centrifugal or screw compressor which includes one or more impellers that compress the refrigerant. The impellers are mounted on a rotating shaft which is supported by a plurality of bearings. The bearings require a steady supply of lubricant, which is often oil. However, in some recent applications, refrigerant has also been used to lubricate the bearings rather than oil. For that, a so-called lubrication cycle is provided which has at least one lubricating refrigerant supply line for providing refrigerant as lubricant to the bearings. Injection devices, e.g. nozzles, are provided to introduce the lubricating refrigerant into the bearings, through which the lubricating refrigerant passes. Further, a pump may be used to transport the lubricating refrigerant through the lubrication cycle.

In pure refrigerant lubrication systems, where the refrigerant is solely used as lubricant for the bearing assembly, the lubricating refrigerant is taken from the condenser unit during steady state operation by means of a lubricating refrigerant supply line, and fed back to the refrigerant cycle at the evaporator unit. The branching off of the lubricating refrigerant from the condenser unit might disadvantageously result in a pressure variation compared to the pressure level of the condenser unit. This in turn might cause a portion of the liquid lubricating refrigerant originating from the condenser to become gaseous, such that a mixture of gaseous and liquid phase lubricating refrigerant is fed to the bearing assembly. The vapor (gaseous phase lubricating refrigerant) in turn impairs the lubrication of the bearings.

Additionally, when the lubricating refrigerant passes through the nozzles, the pressure of the lubricating refrigerant drops. This also results in vaporizing part of the lubricating refrigerant, which increases the amount of gaseous phase lubricating refrigerant in the mixture of already gaseous and liquid phase lubricating refrigerant. As such, lubrication of the bearings is even further impaired.

SUMMARY OF THE INVENTION

It is therefore object of the present invention to provide a cooling system with improved lubrication features.

In the present application, a cooling system is disclosed which comprises a refrigerant cycle for cycling refrigerant from at least a compressor unit, which compresses gaseous refrigerant, to a condenser unit for condensing gaseous refrigerant to liquid refrigerant, from the condenser unit to an evaporator unit for evaporating the liquid refrigerant to gaseous refrigerant, and from the evaporating unit back to the compressor unit. Optionally, the refrigerant cycle may also include an economizer unit.

When an economizer unit is provided, the expansion process is separated into two (or more) steps with an economizer in-between. Thereby, the refrigerant from the condenser unit enters a first expansion device, e.g. a pressure reduction valve, which reduces the pressure of the refrigerant. This pressure drop causes a portion of the refrigerant to vaporize, and the resulting mixture of liquid and gaseous phase refrigerant enters the economizer unit. In the economizer unit itself, the gaseous part and the liquid part of the refrigerant are separated, and the gaseous phase refrigerant is fed back to the compressor unit. The liquid phase refrigerant in turn is supplied via a further expansion device, e.g. a further pressure reduction valve, to the evaporator unit.

In such a cooling system, a two-stage compressor is preferably used, wherein gaseous refrigerant originating from the evaporator unit is fed into a first stage of the compressor. A second stage is connected to the economizer unit and is provided with the gaseous part of the refrigerant which has been separated in the economizer unit.

The cooling system further comprises a lubrication cycle having a steady state operation lubricating refrigerant supply line for providing refrigerant as lubricant to a bearing assembly, which may be part of the compressor unit.

To provide a stable supply of lubricating refrigerant to the bearing assembly, the steady state operation lubricating refrigerant supply line branches off from the refrigerant cycle at the condenser unit, or the optional economizer unit for providing refrigerant to the bearing assembly, and reunites with the refrigerant cycle at the evaporator unit, for feeding back lubricating refrigerant from the bearing assembly to the refrigerant cycle. The steady state operation lubricating refrigerant supply line is further connected to at least one injection device for introducing lubricating refrigerant originating from the condenser unit, or from the economizer unit, into the bearing assembly. The injection device can be a separate element, e. g. a nozzle, or simply provided by the steady state operation lubricating refrigerant supply line being fluidly connected to the bearing assembly.

Preferably, the injection device is a nozzle. A nozzle allows for an optimized and guided supply of lubricating refrigerant to the bearing assembly, and thereby results in improved lubrication. Further, nozzles require no active control which simplifies control and operation of the cooling system.

For improving the lubrication features of the cooling system, the amount of gaseous phase lubricating refrigerant in the bearing assembly should be as small as possible. Too much gaseous phase refrigerant fed to the bearings for lubrication may inhibit formation of a lubricant film and the bearings would instead be lubricated by gas, which cannot create a film, such that lubrication will be impaired. To minimize the amount of gas in the lubricant, a vapor separating unit is arranged in the steady state operation lubricating refrigerant supply line, which is adapted to "filter" out the gaseous phase part of the lubricating refrigerant. For that, the vapor separating unit preferably has a vapor collecting section for collecting gaseous phase lubricating refrigerant and a liquid collecting section for collecting liquid phase lubricating refrigerant.

According to a further preferred embodiment, the vapor separating unit is equipped with a float switch. By means of the float switch, the amount of liquid phase lubricating refrigerant present in the vapor separating unit, and particularly in the liquid collection section of the vapor separating unit, may be detected. The detected amount of liquid phase lubricating refrigerant may be used in controlling the operation of the lubrication cycle, as will be explained further below. For controlling operation of the lubrication cycle, at least one control unit may be present.

The utilization of a vapor separating unit further allows for a preferred embodiment, wherein the pressure in the steady state operation lubricating refrigerant supply line is actively reduced. This in turn reduces the amount of gaseous phase lubricating refrigerant which may result due to the pressure drop through the injection device. This in turn reduces the amount of gaseous phase lubricating refrigerant generated by the pressure drop through the injection device, and therefore improves the lubrication of the bearing assembly. Thus, according to a further preferred embodiment, the lubrication cycle further comprises a first pressure reduction device, such as a pressure reduction valve. The first pressure reduction device is arranged upstream of the vapor separating tank and is adapted to reduce the pressure of the lubricating refrigerant in the steady state operation lubricating refrigerant supply line, and therefore also in the vapor separating unit.

Additionally or alternatively, a pressure regulation device may be arranged upstream of the vapor separating unit 28 or upstream of the optionally provided pressure reduction device 26. The pressure regulation device provides or maintains a constant pressure in the lubrication cycle, even if the pressure of the condenser 14 varies due to different operating conditions.

Due to the pressure reduction caused by the first pressure reduction device 26 and/or the pressure regulating device, some of the liquid refrigerant originating from the condenser unit or the economizer unit may evaporate, such that downstream of the pressure reduction device, a mixture of liquid phase and gaseous phase lubricating refrigerant may be present in the steady state operation lubricating refrigerant supply line. This may affect lubrication properties, as a mixture of gaseous phase and liquid phase lubricating refrigerant may already be provided to the injection device and therefore to the bearing assembly.

The vapor separating unit removes gaseous portions of the lubricating refrigerant, so that downstream of the vapor separating unit, liquid lubricating refrigerant having a lower pressure is guided through the steady state operation lubricating refrigerant supply line. This is advantageous for the lubrication of the bearing assembly since, due to the lower pressure, the pressure drop and therefore also the development of gaseous phase lubricating refrigerant, in the bearing is reduced. Further, other devices besides the injection device, e.g. a pump, may be present in the lubrication cycle downstream of the vapor separating unit and optionally the pressure reduction device. Providing a mixture of gaseous phase and liquid phase lubricating refrigerant to these devices may have a detrimental impact on them as well. Additionally, on the suction side of the pump, the pressure is lowered when the pump is in operation. This may release vapor and may impair the operation of and/or damage the pump. To avoid these negative effects, the pressure in the vapor separation unit should not be too low.

By providing a vapor separating unit downstream of the pressure reduction device, lubricating refrigerant, which releases very little vapor after passing through the nozzles, may be provided to the bearing assembly as well as to the other optionally provided devices downstream of the vapor separating unit.

Thereby, it is preferred that the pressure of the lubricating refrigerant reduced by the first pressure reduction device is almost equal to, but still greater than, the level of the evaporator unit. Since the pressure of the cooling system is adjusted so that the refrigerant is evaporating (boiling) at or below the pressure level of the evaporator, reducing the pressure to the evaporator level would cause the lubricating refrigerant to boil. This in turn would result in a situation where all of the lubricating refrigerant would be transformed into the gaseous phase, which would be difficult to pump, so that no liquid phase lubricating refrigerant can be provided to the bearing assembly.

By maintaining the pressure of the lubricating refrigerant downstream of the first pressure reduction valve above the pressure level of the evaporator unit, it can be assured that liquid lubricating refrigerant is provided to the bearing assembly.

Additionally, by reducing the pressure of the lubricating refrigerant to be almost equal to the pressure level of the evaporator unit, the pressure drop through the injection device is greatly reduced, such that only a negligible amount of gaseous phase lubricating refrigerant is generated by the pressure drop through the injection device, which does not impair the lubrication features.

Preferably, by means of the pressure reduction device, a pressure reduction compared to the pressure of the condenser unit, and in particular compared to the overall pressure difference between condenser and evaporator, in the range of 60% to 95% is achieved. Preferably, a pressure reduction of more than 80%, and most preferably of more than 90%, is achieved.

In embodiments including an economizer unit, there is the additional or alternative possibility of using the economizer as vapor separating unit. However, since the pressure level of the economizer unit is typically still quite high, the pressure drop through the injection device still generates such an amount of gaseous phase lubricating refrigerant that the lubrication of the bearing assembly may be impaired.

Thus, for supplying virtually vapor-free lubricating refrigerant to the bearing assembly, it is therefore preferred to also include a vapor separating unit and the optionally provided pressure reduction/regulating device in the steady state operation lubricating refrigerant supply line, even if an economizer unit is used.

According to a further preferred embodiment, the vapor separating unit has an inlet port for introducing lubricating refrigerant comprising a mixture of gaseous phase and liquid phase lubricating refrigerant originating from the condenser unit or the economizer unit via the pressure reduction device into the vapor separating unit, a vapor outlet port branching off from the vapor collecting section of the vapor separating unit for evacuating gaseous phase lubricating refrigerant from the vapor separating unit, and a liquid outlet port branching off from the liquid collecting section of the vapor separating unit for evacuating liquid phase lubricating refrigerant from the vapor separating unit into the steady state operation lubricating refrigerant supply line.

Even when the vapor collecting section of the vapor separating unit is adapted to release vapor to the environment or to another device, it is preferred to feed back the gaseous phase lubricating refrigerant to the refrigerant cycle. For that, a vapor outlet line is provided, which fluidly connects the vapor outlet port, and thereby the vapor collecting section, to the evaporator unit in order to cycle back gaseous phase lubricating refrigerant to the gaseous side of the refrigerant cycle.

Preferably, a second pressure reduction valve is arranged in the vapor outlet line, which is adapted to maintain the pressure in the vapor separating unit higher than the pressure in the evaporator unit. Advantageously, the second pressure reduction device is arranged in the vapor outlet line downstream of the vapor separating unit and upstream of the evaporator unit, which is adapted maintain a pressure level of the vapor separating unit to be more than 5% and less than 40% above the pressure level of the evaporator unit. In a preferred embodiment, the pressure in the vapor separating unit is roughly 10% of the pressure difference between the condenser and the evaporator above the pressure of the evaporator unit.

Preferably, a pump is provided for propelling or driving lubricating refrigerant through the lubrication cycle. Even if the lubricating refrigerant may in principle be transported through the lubrication cycle due to the pressure differential between the condenser unit and the evaporator unit, the use of the pressure reduction device reduces this pressure difference. Further, as mentioned above, when the pressure difference is reduced to be almost equal to the level of the evaporator unit, the propelling force of the pressure differential would be insufficient to transport the lubricating refrigerant through the lubrication cycle. If the pressure difference is adapted to be great enough to propel the lubricating refrigerant through the lubrication cycle, the pressure significantly drops through the injection device, which would result in generation of a large amount of gaseous phase lubricating refrigerant. As mentioned above, this in turn has a negative impact on the lubrication of the bearing assembly, as an insufficient amount of liquid lubricating refrigerant may be provided to the bearing assembly. Therefore, by using a pump as propelling force for the lubricating refrigerant, the pressure in the lubrication cycle may be reduced to nearly the level of the evaporator unit downstream of the first pressure reduction device. As the pump is preferably also arranged downstream of the vapor separating unit, pure liquid lubricating refrigerant is fed to the pump, so that the pump is not cavitating and thereby not damaged by cavitation.

The pressure of the lubricating refrigerant downstream of the pump is increased due to the pump. Thereby, the lubricating refrigerant is subcooled due to the increased pressure. This in turn ensures that almost no additional vapor is generated and is released when the pressure is again reduced through the injection device.

Preferably, operation of the pump is controlled by means of a control unit.

To avoid operating the pump when there is insufficient liquid lubricating refrigerant present in the vapor separating unit, particularly in the liquid collecting section, it is preferred that the vapor separating unit is equipped with the above-mentioned float switch, which is adapted to detect the level of liquid lubricating refrigerant present in the vapor separating unit. This allows for the pump to be stopped, and preferably also an alarm to be triggered, when the detected level of liquid lubricating refrigerant is too low.

Thus, it is preferred that the control unit, which is adapted to control at least the pump, is connected to or at least receives information from the float switch on the detected level of liquid lubricating refrigerant present in the vapor separating unit, and is further adapted to control supply of lubricating refrigerant to the bearing assembly depending on the detected level of liquid lubricating refrigerant. In other words, when the float switch detects that there is an insufficient amount of liquid lubricating refrigerant present in the vapor separating unit, the pump is controlled to stop or prevented from starting and preferably an alarm is also triggered.

According to a further preferred embodiment, a start-up lubricating refrigerant supply line is provided which is connected to the evaporator unit and is adapted to provide lubricating refrigerant originating from the evaporator unit to the at least one bearing assembly. Thus, both lines, the steady state lubricating refrigerant supply line and the start-up lubricating refrigerant supply line, are adapted to supply refrigerant to the bearing assembly. The use of the refrigerant from the evaporator unit is preferred at startup of the cooling system. At the startup phase, the refrigerant in the evaporator is liquid and can be used for lubricating the bearings before the compressor is started, while there is no liquid refrigerant in the condenser unit that can be used for lubricating the bearing assembly. Using refrigerant from the evaporator unit enables a "pre-lubrication cycle" during which refrigerant is provided to the bearing assembly before the compressor unit starts operating. This, in turn, ensures that there is a sufficient lubrication of the bearing assembly at all times. Thereby, the service life of the compressor unit may be prolonged.

It is further preferred that the start-up lubricating refrigerant supply line merges with the steady state operation lubricating refrigerant supply line downstream of pressure reduction device, preferably downstream of the vapor separating unit. By merging the start-up lubricating refrigerant supply line and the steady state operation supply line, further devices, such as for example the pump, which may also be present in the lubrication cycle, need only to be provided once, regardless of whether the lubricating refrigerant is originating from the condenser/economizer unit or the evaporator unit.

Since the pressure in the evaporator unit is much lower than the pressure in the condenser and essentially the same as the pressure in the bearing assembly, the risk for generating vapor due to a pressure reduction through the nozzles is minimized. Additionally, during start-up, no gaseous phase lubricating refrigerant is present at all. Therefore, it is preferred to merge the supply lines downstream and not upstream of the vapor separating unit or downstream and not upstream of the pressure reduction device.

According to a preferred embodiment, a three-way valve is provided for merging the start-up lubricating refrigerant supply line and the steady state operation lubricating refrigerant supply line. Specifically, the three-way valve has a first inlet port, which is connected to an upstream section of the steady state operation lubricating refrigerant supply line, which includes the vapor separating unit, a second inlet port which is connected to the start-up lubricating refrigerant supply line, and an outlet port which is connected to a downstream section of the steady state operation lubricating refrigerant supply line, which guides lubricating refrigerant to the bearing assembly.

The three-way valve may be controlled by a control unit to supply the lubricating refrigerant via the upstream section of the steady state operation lubricating refrigerant supply line or via the start-up lubricating refrigerant supply line to the downstream sections of the steady state operation lubricating refrigerant supply line. Preferably, the above mentioned control unit is not only adapted to control the pump, but also the three-way valve. However, it is of course possible to use a separate control unit for each unit to be controlled, i.e., one for the pump and another one for the three-way valve.

The use of a control unit for controlling the three-way valve allows for an operation of the cooling system, in which, at start-up of the cooling system, there is no pressure difference between the condenser and the evaporator. The refrigerant is liquid and located in the evaporator. Then, the three-way valve is controlled to connect the evaporator unit to the pump, and the pump is controlled to pump, so that the lubricating refrigerant is supplied by means of the start-up lubricating refrigerant supply line to the bearing assembly.

As pressure builds up in the cooling system, gaseous phase refrigerant condenses in the condenser unit. A small fraction of the condensed refrigerant, driven by the system pressure, flows into a vapor separating unit after passing through the pressure reduction device. As mentioned above, the pressure reduction device is adapted to control the pressure in the vapor separating unit to be slightly greater than the pressure in the evaporator unit. As the pressure of the lubricating refrigerant is reduced, gaseous phase lubricating refrigerant is released, which results in a mixture of gaseous phase and liquid phase lubricating refrigerant downstream of the pressure reduction device, which is then fed into the vapor separating unit. In the vapor separating unit, the mixture is separated, and the gaseous phase lubricating refrigerant is collected in the vapor collecting section and the liquid phase lubricating refrigerant is collected in the liquid collecting section.

When the vapor separating unit is equipped with the float switch, the control unit is further adapted to control the supply of the lubricating refrigerant via the steady state operation lubricating refrigerant supply line or via the start-up lubricating refrigerant supply line depending on the detected level of liquid lubricating refrigerant.

Thus, when the float switch senses that liquid refrigerant is present in the vapor separating unit, the three-way valve is controlled to close the second inlet port to the start-up lubricating refrigerant supply line and to open the first inlet port to the steady state lubricating refrigerant supply line, so that lubricating refrigerant is drawn from the liquid collecting section of the vapor separating unit instead of from the evaporator unit.

According to a further preferred embodiment, the control unit is adapted to control the three-way valve and the pump based on the detected level of lubricating refrigerant by means of the flow switch in such a way that:

In a start-up phase of the cooling system, the control unit is adapted to control the three-way valve to open the second inlet port, which is connected to the start-up lubricating refrigerant supply line, until the float switch detects that a level of lubricating refrigerant is above a predetermined level, and is further adapted to control the three-way valve to close the second inlet port and to open the first inlet port, if the float switch has detected that the level of lubricating refrigerant is above the predetermined level;

In a steady state operation phase of the cooling system, the control unit is adapted to control the pump to stop when the float switch has detected that the level of lubricating refrigerant is below the predetermined level and to output or trigger an alarm; and In a shutdown phase of the cooling system, the control unit is adapted to control the pump to stop, the three-way valve outlet port to close, and both three-way valve inlet ports to open so that liquid lubricating refrigerant present in the vapor separating unit is recycled from the vapor separating unit to the evaporator unit, or to control the three-way valve to close the second inlet port, and controlling the pump to stop as soon as the detected level of lubricating refrigerant is below the predetermined level of lubricating refrigerant, and subsequently controlling the three-way valve to close the first inlet port.

According to a further preferred embodiment, the cooling system further comprises a filter unit which is arranged in the lubricating refrigerant supply line upstream of the bearing assembly. Thereby, the filter unit may be arranged in the steady state operation lubricating refrigerant supply line downstream of the three-way valve or even downstream of the pump. This filter unit ensures that harmful substances, e.g. water and/or other substances, which may occur due to a break-down of the molecules of the refrigerant due to heat, pressure and/or mechanical abrasion, are filtered out of the refrigerant so that the refrigerant which is used for lubricating the bearing assembly is not contaminated. Advantageously, the filter comprises at least one unit for filtering out liquids, such as water and acids, and a second for filtering out contaminate particles.

According to a further preferred embodiment, an accumulator is arranged in the lubrication cycle line upstream of the bearing assembly. During start-up, the pump feeds refrigerant to the bearings and also to the accumulator, so that a reservoir of pressurized refrigerant is built up in the accumulator at the same time. This ensures that continuous lubrication is provided to the bearing assembly even if, at any point during operation of the cooling system, there is not enough liquid lubricating refrigerant in the vapor separating unit to feed the pump. The accumulator may also serve as pressurized lubrication refrigerant reservoir at start-up instead of the pump or when the pump is not working. Consequently, the accumulator is preferably adapted to operate in a pre-lubrication cycle, before the compressor is started. Further, when the pump is stopped due to the detected level of lubricating refrigerant present in the vapor separating unit, the refrigerant stored in the accumulator may provide refrigerant for temporary lubrication.

Preferably, the accumulator has two compartments, one on the top that is filled with a gas or containing a spring and a second that is used for storing pressurized refrigerant. The two compartments are separated by a piston or a rubber bladder.

Such an accumulator works as follows. At start of the relubrication cycle, the second compartment of the accumulator is empty. As pressure builds up, the second compartment starts to fill up with liquid refrigerant. The pressure is balanced by the pressure of the compressed gas in the first compartment or by the compression of the spring (if used). At steady state operation, the two compartments have approximately the same volume. This is controlled by selection of gas pressure or spring force in the first compartment.

As mentioned above, the volume of pressurized liquid refrigerant in the second compartments serves as reserve lubricant when there is a malfunction of the system for any reason or when not enough liquid lubricating refrigerant is present in the vapor separating unit. It is therefore preferred that the accumulator is arranged directly upstream of the bearing assembly and downstream of any other devices such as pump or filter units.

A further aspect of the present invention relates to a method for operating a cooling system, wherein the cooling system comprises a refrigerant cycle and a lubrication cycle as mentioned above, and wherein the refrigerant of the refrigerant cycle is used as lubricant in the lubrication cycle.

For that, the lubricating refrigerant is branched off from the condenser unit or from an optionally provided economizer unit, as is also mentioned above.

The lubrication cycle comprises a pressure reduction device and a vapor separation unit with a float switch downstream of the pressure reduction device for ensuring that mainly liquid lubricating refrigerant is provided to the bearing to be lubricated. The lubrication cycle further comprises a three-way valve and a pump which are controlled by a control unit depending on a detected level of liquid lubricating refrigerant present in the vapor separating unit, as also described above. Further, the lubrication cycle comprises a steady state operation lubricating refrigerant supply line as well as a start-up lubricating refrigerant supply line, wherein the start-up lubricating refrigerant supply line merges into the steady state operation lubricating refrigerant supply line by means of the three-way valve.

To operate such a cooling system, the method performs the following steps:

- detecting a level of liquid lubricating refrigerant in the vapor separation unit by means of the float switch;
- comparing the detected level of liquid lubricating refrigerant with a predetermined level of liquid lubricating refrigerant by means of the control unit;
- controlling the three-way valve by means of the control unit to open the first port, which is connected to the upstream section of the steady state operation lubricating refrigerant supply line for supplying lubricating refrigerant originating from the condenser unit or the economizer unit to the bearing assembly when the detected level of liquid lubricating refrigerant is above the predetermined level, and
- controlling the three-way valve by means the control unit the three-way valve to open the second inlet port, which is connected to the start-up lubricating refrigerant supply line, when the detected level of liquid lubricating refrigerant is lower than the predetermined level.

Optionally, the method also performs one or more of the following steps:

- In a start-up phase of the cooling system,
  - controlling the three-way valve to open the second inlet port,
  - continuously monitoring the level of the lubricating refrigerant by means of the float switch;
  - comparing the detected level of lubricating refrigerant with a predetermined level of lubricating refrigerant;
  - controlling the three-way valve to close the second inlet port and to open the first inlet port, as soon as the detected level of lubricating refrigerant is above the predetermined level;
- In a steady state operation phase of the cooling system,
  - continuously monitoring the level of the lubricating refrigerant by means of the float switch;
  - comparing the detected level of lubricating refrigerant with a predetermined level of lubricating refrigerant;
  - controlling the pump to stop as soon as the detected level of lubricating refrigerant is below the predetermined level;
  - outputting or triggering an alarm; and
- In a shut-down phase of the cooling system,
  - continuously monitoring the level of the lubricating refrigerant by means of the float switch;
  - comparing the detected level of lubricating refrigerant with a predetermined level of lubricating refrigerant;
  - selecting one of the following shut down procedures:
    - controlling the pump to stop, and preferably triggering an alarm,
    - controlling the three-way valve to close the outlet port,
    - controlling the three-way valve to open the first and second inlet port so that liquid lubricating refrigerant being present in the vapor separating unit is recycled from the vapor separating unit to the evaporator unit; and controlling the three-way valve to close the first and second inlet port as soon as the detected level of lubricating refrigerant is below the predetermined level of lubricating refrigerant; or
    - controlling the three-way valve to close the second inlet port, and controlling the pump to stop and preferably triggering an alarm as soon as the detected level of lubricating refrigerant is below the predetermined level of lubricating refrigerant, and subsequently controlling the three-way valve to close the first inlet port.

Further preferred embodiments are disclosed in the dependent claims as well as in the description and the figures. Thereby, elements described or shown in combination with other elements may be present alone or in combination with other elements without departing from the scope of protection.

BRIEF DESCRIPTION OF THE SEVERAL VIEWS OF THE DRAWINGS

In the following, preferred embodiments of the invention are described in relation to the drawings, wherein the drawings are exemplarily only, and are not intended to limit the scope of protection. The scope of protection is only defined by the accompanying claims. The figures show:

DETAILED DESCRIPTION OF THE INVENTION

Figure 1:
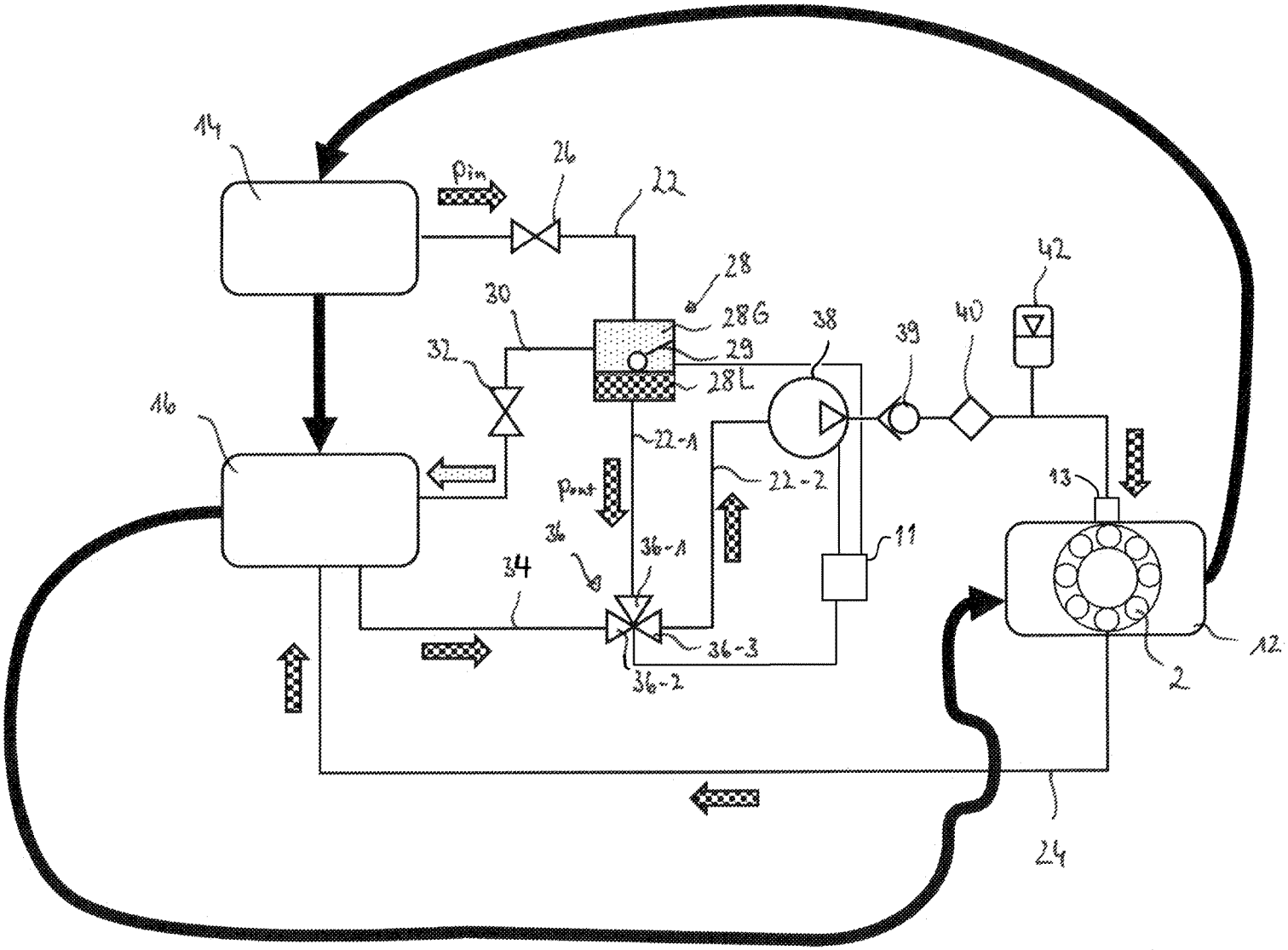
FIG. 1 is a schematic illustration of a first embodiment of a cooling system with refrigerant lubricated bearing assembly.

In the following same or similar functioning elements are indicated with the same reference numerals.

Figure 2:
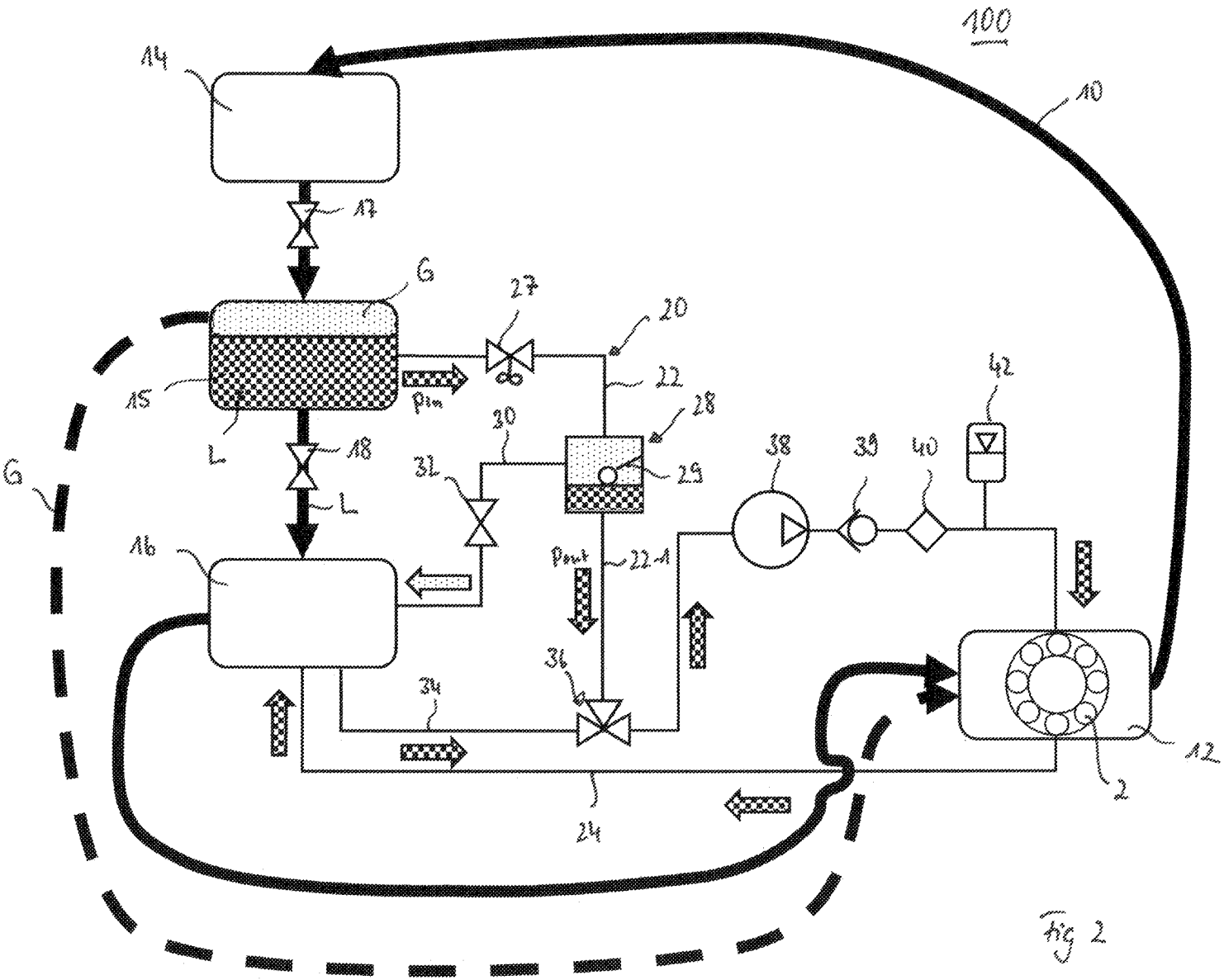
FIG. 2 is a schematic illustration of a second embodiment of a cooling system with refrigerant lubricated bearing assembly.

FIGS. 1 and 2 show each a schematic illustration of a cooling system 100 with a cooling cycle 10 (indicated by thicker arrows) and a lubrication cycle 20 (indicated by thinner arrows), wherein the lubrication cycle 20 also includes refrigerant as lubricant.

A cooling system 100, such as a chiller or air conditioning system, generally includes in the cooling cycle 10 a compressor unit 12, a condenser unit 14 and an evaporator unit 16.

As can be seen in the cooling cycle 10 of FIGS. 1 and 2, the compressor unit 12 compresses gaseous refrigerant, which is directed to the condenser unit 14 for condensing the gaseous refrigerant into liquid refrigerant. The liquid refrigerant is then fed to the evaporator unit 16 through an expansion valve for evaporating the liquid refrigerant to gaseous refrigerant, which is then transported back to the compressor unit 12 for again providing compressed gaseous refrigerant.

Optionally, an economizer unit 15 may be provided, as is illustrated in FIG. 2. In this case, it is also preferred to use a multistage compressor unit, e.g., a two stage compressor. In such a cooling system, the expansion process is separated into two (or more) steps with the economizer unit 15 located in between. Thereby, the liquid refrigerant from the condenser unit 14 enters a first expansion valve 17 upstream of the economizer unit 15, which reduces the pressure of the refrigerant. This pressure drop causes a portion of the liquid refrigerant to evaporate, so that a mixture of liquid phase and gaseous phase refrigerant enters the economizer unit 15. In the economizer unit 15 itself, the gaseous part G and the liquid part L of the refrigerant are separated, and the gaseous phase refrigerant G is fed back to the compressor unit 12 (dashed arrow). The liquid phase refrigerant L is in turn supplied to a further expansion valve 18 and further to the evaporator unit 16.

The compressor unit 12 includes a bearing assembly 2 with at least one and typically a plurality of rolling bearings. The bearing assembly 2 is only schematically illustrated in FIGS. 1 and 2. The bearing assembly 2 generally requires lubrication during operation. In order to simplify the design of the cooling system 100, the refrigerant is used not only in the cooling cycle 10, but also in the lubrication cycle 20 for lubricating the bearing assembly 2, i.e., by using the refrigerant as lubricant for the bearing assembly 2.

As illustrated in FIGS. 1 and 2, to provide the lubricating refrigerant to the bearing assembly 2, a part or portion of the refrigerant is branched off from the condenser unit 14 by a steady state operation lubricating refrigerant supply line 22 and guided to the bearing assembly 2 in the compressor unit 12. The lubricating refrigerant is then introduced into the bearing assembly 2, usually at high pressure and through a nozzle or injection device 13, and exits the compressor unit 12 via a lubricating refrigerant feedback line 24 for feeding back the lubricating refrigerant to the evaporator unit 16.

Since the pressure level of the condenser unit 14 is much higher than the pressure level of the evaporator unit 16, there is a significant pressure drop through the nozzle. Due to this pressure drop, part of the lubricating refrigerant is transformed from its liquid phase to its gaseous phase (usually more than 30%), which results in such a high amount of gaseous phase lubricating refrigerant that a sufficient lubrication of the bearing assembly 2 cannot be ensured if the lubricating refrigerant were to be fed directly to the bearing assembly 2.

Therefore, the cooling system 100 of the present invention reduces the pressure in the lubrication cycle 20 by means of a pressure reduction device 26, particularly a pressure reduction valve. This in turn results in a reduced amount of gaseous phase lubricating refrigerant generated by the pressure drop through the injection device 13 and therefore in improved lubrication of the bearing assembly 2.

Alternatively, a pressure regulating device 27 may be arranged upstream of the pressure reduction device 26, as is illustrated in FIG. 2. It should be noted that the pressure regulating device 27 can also be used in addition to the pressure reduction device 26. The pressure regulating device 27 ensures that constant pressure is maintained upstream of the pressure reduction valve even if the pressure level of the condenser unit 14 varies depending on operating conditions. Additionally, the pressure regulating device 27 may ensure that a constant pressure of a selectable level is provided downstream of the pressure regulating device 27. This, in turn, allows for a defined level of pressure reduction and eventually a defined maximum percentage of generated gaseous phase lubricating refrigerant during the pressure drop through the injection device 13.

Preferably, the pressure is reduced to almost the level of the pressure in the evaporator unit 16, such that only a negligible amount of gaseous phase lubricating refrigerant is generated through the nozzle. Unfortunately, such a high pressure reduction would result in the generation of a large amount of gaseous phase lubricating refrigerant by the transfer through the pressure reduction valve 26. Therefore, a vapor separating unit 28 is preferably arranged downstream of the pressure reduction valve 26. By providing a vapor separating unit 28 downstream of the pressure reduction valve 26, virtually vapor free lubricating refrigerant may be provided to the bearing assembly 2, even if the pressure is reduced to almost the evaporator unit pressure level.

The vapor separating unit 28 includes a liquid collection section 28L and a vapor collecting section 28G. As can be further seen in FIGS. 1 and 2, the vapor collecting section 28G of the vapor separating unit 28 is connected by a vapor outlet line 30, which is connected to the evaporator unit 16 for feeding back gaseous phase lubricating refrigerant to the gaseous side of the refrigerant cycle. In the vapor outlet line 30, a second pressure reduction device 32 is arranged, which ensures that the pressure in the vapor separating unit 28 is higher than the pressure in the evaporator unit 16.

The liquid collecting section 28L of the vapor separating unit 28, on the other hand, remains connected to the steady state operation lubricating refrigerant supply line 22, but the pressure pout of the lubricating refrigerant downstream of the vapor separating unit 28 is near the level of pressure of the evaporator unit 16, wherein the pressure pin of the lubricating refrigerant, which enters the pressure reduction valve 26, is about the pressure of the condenser unit 14.

A level of liquid lubricating refrigerant collected in the liquid collecting section 28L of the vapor separating unit 28 can be detected by a so called "float switch" 29, which provides the detected level of liquid lubricating refrigerant to a control unit 11.

Since the liquid collecting section 28L of the vapor separating unit 28 is empty at start-up of the cooling system 100, liquid refrigerant for lubrication is only available in the evaporator unit 16. Liquid refrigerant only becomes available in the condenser unit 14, and later in the liquid collecting section 28L of the vapor separating unit 28, as the system pressure is building up. Therefore, as further illustrated in the drawing figures, the cooling system 100 and particularly the lubrication cycle 20 further comprises a start-up lubricating refrigerant supply line 34, which branches off from the evaporator unit 16 and merges into the steady state operation lubricating refrigerant supply line 22 by means of a three-way valve 36. The three-way valve 36 includes a first inlet port 36-1 connected to an upstream part 22-1 of the steady state lubricating refrigerant supply line 22, a second inlet port 36-2 connected to the start-up lubricating refrigerant supply line 34, and an outlet port 36-3 connected to a downstream part 22-2 of the steady state operation lubricating refrigerant supply line.

During start-up, the three-way valve 36 is then operated, e.g. by the control unit 11, to open the start-up lubricating refrigerant supply line 34, so that lubricating refrigerant is drawn from the evaporator unit 16. This ensures that lubricating refrigerant can be provided at the bearing assembly 2 of the compressor 12 even before the compressor 12 is started, which increases the service life of the compressor 12.

Since the pressure pout downstream of the vapor separating unit 28 is near the pressure of the evaporator unit 26, or is the pressure of the evaporator unit 16 of the start-up lubricating refrigerant supply line 34, there is no sufficient pressure difference for propelling or driving the flow of lubricating refrigerant in the lubricating cycle 10 by means of pressure only. Therefore, the cooling system 10 preferably further comprises a pump 38 for propelling or pumping the lubricating refrigerant through the lubrication cycle. Downstream of the pump 38, the pressure of the lubricating refrigerant is again increased. This in turn results in a subcooling of the lubricating refrigerant, which in turn ensures that almost no additional vapor is released when the pressure of the lubricating refrigerant is reduced during passage through the injection device 13. In order to avoid any backflow of the refrigerant through the pump 38, due to the increased pressure downstream of the pump 38, a check valve 39 is arranged downstream of the pump 38.

Unfortunately, since the refrigerant is also used as refrigerant in the cooling cycle 10, the refrigerant is exposed to several mechanical components, e.g. compressor, condenser, evaporator, connecting lines, and thereby heat and pressure, as well as to liquid and/or gaseous contaminants, e.g. air and moisture, which may cause the molecules in the refrigerant to break down and produce byproduct compounds, which are harmful to the bearing assembly 2 used in the compressor unit 12. Additionally, such a breakdown of the refrigerant molecules may even be caused by an inherent chemical instability of the refrigerant itself. Further, foreign particles, such as originating from wear or abrasion of the mechanical components, may be present in the refrigerant and these particles may be harmful to the bearing assembly 2 when the refrigerant is used as a lubricant. More specifically, these byproduct compounds and/or particles may be very harmful to the refrigerant lubricated bearing assembly as they may lead to corrosion, increased wear, insufficient lubrication conditions or cause otherwise damage in the bearing assembly.

Consequently, at least one filter 40, preferably an assembly of filter units (not illustrated), or an arrangement of individual and combined filter units is provided in the lubricating refrigerant supply line 22 upstream of the bearing assembly 2. The filter unit(s) 40 contain materials that may absorb or react with the byproducts, contaminants and/or particles, thereby removing the particles, acids or water from the refrigerant.

The filter unit(s) 40 are preferably adapted to absorb, adsorb, catch and/or trap certain molecules from the refrigerant by mechanical, chemical and/or physical adsorption, the type of adsorption/trapping being dependent on the material type, the surrounding environment composition, and the expected type of contaminant.

As mentioned above, in addition to the arrangement of filter units, it is also possible to combine some or all filter units for reducing the overall required space or to use synergistic effects, e.g. use a combination of an acid filter and a desiccant filter. This is particularly preferable, as some of the adoption reaction of acids are competitive to the adsorption of water/moisture, or as mentioned above the reaction product of the chemical reaction may be water, which also needs to be removed from the refrigerant.

As further illustrated in FIGS. 1 and 2, an accumulator 42 is arranged in the lubricating refrigerant supply line 22. The accumulator 42 ensures that a constant lubricating refrigerant supply is provided at the compressor unit 12 even when insufficient lubricating refrigerant is collected in the vapor separating unit 28 or the pump 38 is not working. Consequently, the accumulator 42 works as an additional auxiliary reservoir for refrigerant, which may be fed to the bearing assembly 2 when an insufficient lubricating refrigerant supply is detected in the steady state operation lubricating refrigerant supply line 22.

The cooling system 100 illustrated in FIGS. 1 and 2 works as follows, wherein the control unit 11 controls operation of the three-way valve 36 and the pump 38 and is provided with information on the detected level of liquid lubricating refrigerant being present in the vapor separation unit 28 by means of the float switch 29.

At start-up of the cooling system 100, there is no pressure difference between the condenser unit 12 and the evaporator unit 16. The refrigerant is liquid and located only within the evaporator unit 16, as the liquid collecting section of the vapor separating unit 28 is empty. Then, the three-way valve 36 is controlled to open the start-up lubricating refrigerant supply line 34 in order to connect the evaporator unit 16 to the pump 38, and the pump 38 is controlled to operate, so that liquid lubricating refrigerant is drawn from the evaporator unit 16 and provided to the bearing assembly 2 via the start-up lubricating refrigerant supply line 34.

As soon as lubricating refrigerant is lubricating the bearing assembly 2, and preferably also as soon as the accumulator 42 is filled, the compressor unit 12 starts operation.

As pressure builds up in the cooling system 100, gaseous phase refrigerant condenses in the condenser unit 12. A small fraction of the condensed liquid refrigerant, driven by the system pressure, flows into the steady state operation lubricating refrigerant supply line 22 and further into the pressure reduction valve 26. In the pressure reduction valve 26, the pressure of the lubricating refrigerant is reduced to almost evaporator unit level, which causes part of the lubricating refrigerant to evaporate so that a mixture of liquid and gaseous phase lubricating refrigerant exits the pressure reduction valve 26. This mixture of gaseous phase and liquid phase lubricating refrigerant is fed into the vapor separating unit 28, where gaseous phase and liquid phase are again separated.

The gaseous part is collected in the vapor collecting section 28G and recycled to the evaporator unit 16.

The liquid part is collected in the liquid collecting section 28L of the vapor separating unit 28 so that the level of liquid lubricating refrigerant present in the vapor separating unit increases. This level is detected by the float switch 29 and compared to a predetermined level by means of the control unit 11.

As soon as the level of the liquid lubricating refrigerant has reached the predetermined level, the three-way valve 36 is controlled to close the second inlet port 36-2 to the start-up lubricating refrigerant supply line 34 and to open the first inlet port 36-1 to the steady state lubricating refrigerant supply line 22, so that lubricating refrigerant is drawn from the liquid collecting section 28L of the vapor separating unit 28 instead of from the evaporator unit 16.

The cooling system has then reached the steady state operation situation. During steady state, the level of liquid lubricating refrigerant is constantly monitored and compared to the predetermined level. When the detected level drops under the predetermined level, the pump 38 is stopped and preferably an alarm is triggered or output to a user.

For shutdown of the cooling system, the control unit 11 can select between at least two possible scenarios.

In one scenario, the control unit 11 controls the pump 38 to stop, the three-way valve 36 to close the outlet port 36-3, the three-way valve 36 to open the first and second inlet port 36-1, 36-2, so that liquid lubricating refrigerant being present in the vapor separating unit 28 is recycled from the vapor separating unit 28 to the evaporator unit 16. Further, as soon as the float switch 29 detects that the vapor separating unit 28 is empty, the control unit 11 controls the three-way valve to also close the first and second inlet port 36-1, 36-2.

According to another scenario, operation of the refrigerant cycle is terminated, but similarly to the start-up phase, the lubrication cycle is operated until the float switch 29 detects that the vapor separating nit 29 is empty. Then, the control unit 11 controls the three-way valve 36 to close the second inlet port 36-2, and the pump 38 to stop, and subsequently controlling or directing the three-way valve 36 to close the first inlet port 36-1.

In summary the suggested cooling system has the advantage that virtually pure liquid lubricating refrigerant can be used for lubricating the bearing assembly 2 as the generation of gaseous phase lubricating refrigerant due to the pressure drop through the injection device 13 is negligible.

Representative, non-limiting examples of the present invention were described above in detail with reference to the attached drawings. This detailed description is merely intended to teach a person of skill in the art further details for practicing preferred aspects of the present teachings and is not intended to limit the scope of the invention.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter. The invention is not restricted to the above-described embodiments, and may be varied within the scope of the following claims.

REFERENCE NUMERALS

100 Cooling system
10 Cooling cycle
12 compressor unit
14 condenser unit
15 economizer unit
16 evaporator unit
17, 18 expansion device
20 lubrication cycle
22 steady state operation lubricating refrigerant supply line
22-1 upstream part of the steady state operation lubricating refrigerant supply line
22-2 downstream part of the steady state operation lubricating refrigerant supply line
24 lubricating refrigerant feedback line
26 pressure reduction device
28 vapor separating unit
29G vapor collecting section of the vapor separating unit
28L liquid collecting section of the vapor separating unit
29 float switch
30 vapor outlet line
32 second pressure reduction device
34 start-up lubricating refrigerant supply line
36 3-way valve
36-1 first inlet port
36-2 second inlet port
36-3 outlet port
38 pump
40 filter
42 accumulator

We claim:

1. A cooling system comprising:

a refrigerant cycle including at least a compressor unit for compressing gaseous refrigerant, a condenser unit for condensing gaseous refrigerant to liquid refrigerant, an optional economizer unit for reducing the pressure of the refrigerant and partially evaporating the liquid refrigerant, and an evaporator unit for evaporating the liquid refrigerant back to gaseous refrigerant, wherein the refrigerant is cycled from the compressor unit to the condenser unit, from the condenser unit to evaporator unit, optionally via the economizer unit, and from the evaporating unit back to the compressor unit, wherein the compressor unit includes at least one bearing assembly;

a lubrication cycle for providing liquid refrigerant as lubricant to the at least one bearing assembly, the lubrication cycle having a steady state operation lubricating refrigerant supply line branched off from the condenser unit or from the economizer unit and to the at least one bearing assembly and connected to at least one injection device for introducing lubricating refrigerant from the condenser unit or from the economizer unit into the bearing assembly, and a vapor separating unit arranged in the steady state operation lubricating refrigerant supply line and adapted to separate gaseous phase lubricating refrigerant from liquid phase lubricating refrigerant; and a first pressure reduction device arranged in the steady state operation lubricating refrigerant supply line upstream of the vapor separating unit and adapted to reduce pressure of the lubricating refrigerant in the steady state operation lubricating refrigerant supply line;

wherein pressure of the lubricating refrigerant downstream of the first pressure reduction device is reduced by 60% to 95% of a pressure difference between the condenser unit and the evaporator unit.

2. The cooling system according to claim 1, wherein the vapor separating unit has a vapor collecting section for collecting gaseous phase lubricating refrigerant and a liquid collecting section for collecting liquid phase lubricating refrigerant.

3. The cooling system according to claim 1, wherein the vapor separating unit includes a float switch adapted to detect a level of liquid lubricating refrigerant within the vapor separating unit.

4. The cooling system according to claim 1, wherein the vapor separating unit is further connected to a vapor recycling line fluidly connecting the vapor separating unit with the evaporator unit.

5. The cooling system according to claim 1, further including a pressure regulating device arranged in the steady state operation lubricating refrigerant supply line downstream of the condenser unit and upstream of the first pressure reduction device.

6. The cooling system according to claim 1, further including a second pressure reduction device arranged in the vapor recycling line downstream of the vapor separating unit and upstream of the evaporator unit, the second pressure reduction device being adapted to maintain a pressure level of the vapor separating unit to be more than 5% and less than 40% of a pressure difference between the condenser unit and the evaporator unit above the pressure level of the evaporator unit.

7. The cooling system according to claim 1, further including a pump arranged upstream of the at least one bearing assembly and downstream of the vapor separating unit.

8. The cooling system according to claim 1, further including a start-up lubricating refrigerant supply line connected to the evaporator unit and adapted to provide lubricating refrigerant from the evaporator unit to the at least one bearing assembly.

9. The cooling system according to claim 8, wherein the start-up lubricating refrigerant supply line merges with the steady state operation lubricating refrigerant supply line downstream of the vapor separating unit.

10. The cooling system according to claim 9, further including a three-way valve adapted to merge the start-up lubricating refrigerant supply line and the steady state operation lubricating refrigerant supply line, the three-way valve having a first inlet port connected to an upstream section of the steady state operation lubricating refrigerant supply line, which includes the vapor separating unit, a second inlet port connected to the start-up lubricating refrigerant supply line, and an outlet port connected to a downstream section of the steady state operation lubricating refrigerant supply line and adapted to guide lubricating refrigerant to the bearing assembly.

11. The cooling system according to claim 10, wherein the cooling system further includes a control unit adapted to control operation of the pump and/or the three-way valve.

12. The cooling system according to claim 11, wherein the control unit is connected to or at least receives information from the float switch on the detected level of liquid lubricating refrigerant being present in the vapor separating unit and is further adapted to control the pump and/or the three-way valve depending on the detected level of liquid lubricating refrigerant.

13. The cooling system according to claim 12, wherein control unit is adapted to control the three-way valve so as to:

open the first port, which is connected to the upstream section of the steady state operation lubricating refrigerant supply line for supplying lubricating refrigerant originating from the condenser unit or the economizer unit to the bearing assembly when the float switch detects that a level of liquid lubricating refrigerant is above a predetermined level, and open the second inlet port, which is connected to the start-up lubricating refrigerant supply line, when the float switch detects that a level of liquid lubricating refrigerant is lower than a predetermined level.

14. The cooling system according to claim 13, wherein the control unit is adapted to control the pump and the three-way valve so as to:

in a start-up phase of the cooling system, the control unit is adapted to control the three-way valve to open the second inlet port, which is connected to the start-up lubricating refrigerant supply line, until the float switch detects that a level of lubricating refrigerant is above a predetermined level, and is further adapted to control the three-way valve to close the second inlet port and to open the first inlet port, if the float switch has detected that the level of lubricating refrigerant is above the predetermined level;

in a steady state operation phase of the cooling system, the control unit is adapted to control the pump to stop when the float switch has detected that the level of lubricating refrigerant is below the predetermined level and to output or trigger an alarm;

in a shutdown phase of the cooling system, the control unit is adapted to either: control the pump to stop, the three-way valve outlet port to close, and both three-way valve inlet ports to open so that liquid lubricating refrigerant being present in the vapor separating unit is re-cycled from the vapor separating unit to the evaporator unit, or to control the three-way valve to close the second inlet port, and control the pump to stop as soon as the detected level of lubricating refrigerant is below the predetermined level of lubricating refrigerant, and subsequently to control the three-way valve to close the first inlet port.

15. The cooling system according to claim 1, further comprising at least one filter unit and/or at least one accumulator arranged upstream of the at least one bearing assembly and downstream of the vapor separating unit.

16. A method for operating a cooling system comprising:

providing at least a compressor unit for compressing gaseous refrigerant, a condenser unit for condensing gaseous refrigerant to liquid refrigerant, an optional economizer unit for reducing the pressure of the refrigerant and already partly evaporating the liquid refrigerant, and an evaporator unit for evaporating the liquid refrigerant back to gaseous refrigerant, wherein the refrigerant is cycled from the compressor unit to the condenser unit, from the condenser unit to evaporator unit, optionally via the economizer unit, and from the evaporating unit back to the compressor unit, wherein the compressor unit comprises at least one bearing assembly;

providing a lubrication cycle for providing liquid refrigerant as lubricant to the at least one bearing assembly, the lubrication cycle having a steady state operation lubricating refrigerant supply line, which is branched off from the condenser unit or from the economizer unit to the bearing assembly and is connected to at least one injection device for introducing lubricating refrigerant originating from the condenser unit or the economizer unit into the bearing assembly, and a start-up lubricating refrigerant supply line which is connected to the evaporator unit and is adapted to provide lubricating refrigerant originating from the evaporator unit to the at least one bearing assembly, wherein the start-up lubricating refrigerant supply line merges with the steady state operation lubricating refrigerant supply line by means of a three-way valve having a first inlet port which is connected to an upstream section of the steady state operation lubricating refrigerant supply line, a second inlet port which is connected to the start-up lubricating refrigerant supply line, and an outlet port which is connected to a downstream section of the steady state operation lubricating refrigerant supply line, which guides lubricating refrigerant to the bearing assembly;

wherein in the upstream section of the steady state operation lubricating refrigerant supply line, a pressure reduction valve for reducing the pressure of the lubricating refrigerant is provided, and downstream of the pressure reduction valve, a vapor separating unit for separating gaseous phase lubricating refrigerant from liquid phase lubricating refrigerant is provided, the vapor separating unit including a float switch for detecting a level of liquid lubricating refrigerant present in the vapor separating unit;

wherein a pump is arranged in the downstream section of the steady state operation lubricating refrigerant supply line and adapted to transport lubricating refrigerant in the lubrication cycle;

wherein the lubricating cycle further comprises a control unit adapted to control at least the pump and the three-way valve depending on the detected level of liquid lubricating refrigerant;

detecting a level or liquid lubricating refrigerant in the vapor separation unit by means of the float switch;

comparing the detected level of liquid lubricating refrigerant with a predetermined level of liquid lubricating refrigerant;

controlling the three-way valve to open the first port, which is connected to the upstream section of the steady state operation lubricating refrigerant supply line for supplying lubricating refrigerant originating from the condenser unit or the economizer unit to the bearing assembly when the detected level of liquid lubricating refrigerant is above the predetermined level; and controlling the three-way valve to open the second inlet port, which is connected to the start-up lubricating refrigerant supply line, when the detected level of liquid lubricating refrigerant is lower than the predetermined level.

17. The method according to claim 16, wherein the control unit is further adapted to perform one or more of the following steps:

in a start-up phase of the cooling system:

controlling the three-way valve to open the second inlet port;

continuously monitoring the level of the lubricating refrigerant by means of the float switch;

comparing the detected level of lubricating refrigerant with a predetermined level of lubricating refrigerant; and controlling the three-way valve to close the second inlet port and to open the first inlet port, as soon as the detected level of lubricating refrigerant is above the predetermined level;

in a steady state operation phase of the cooling system:

continuously monitoring the level of the lubricating refrigerant by means of the float switch;

comparing the detected level of lubricating refrigerant with a predetermined level of lubricating refrigerant;

controlling the pump to stop as soon as the detected level of lubricating refrigerant is below the predetermined level; and outputting or triggering an alarm; and in a shut-down phase of the cooling system:

continuously monitoring the level of the lubricating refrigerant by means of the float switch;

comparing the detected level of lubricating refrigerant with a predetermined level of lubricating refrigerant; and selecting one of the following shut down procedures:

controlling the pump to stop, controlling the three-way valve to close the outlet port, controlling the three-way valve to open the first and second inlet port so that liquid lubricating refrigerant being present in the vapor separating unit is recycled from the vapor separating unit to the evaporator unit; and controlling the three-way valve to close the first and second inlet port as soon as the detected level of lubricating refrigerant is below the predetermined level of lubricating refrigerant; or controlling the three-way valve to close the second inlet port, and controlling the pump to stop as soon as the detected level of lubricating refrigerant is below the predetermined level of lubricating refrigerant, and subsequently controlling the three-way valve to close the first inlet port.

18. A cooling system comprising:

a refrigerant cycle including at least a compressor unit for compressing gaseous refrigerant, a condenser unit for condensing gaseous refrigerant to liquid refrigerant, an optional economizer unit for reducing the pressure of the refrigerant and partially evaporating the liquid refrigerant, and an evaporator unit for evaporating the liquid refrigerant back to gaseous refrigerant, wherein the refrigerant is cycled from the compressor unit to the condenser unit, from the condenser unit to evaporator unit, optionally via the economizer unit, and from the evaporating unit back to the compressor unit, wherein the compressor unit includes at least one bearing assembly;

a lubrication cycle for providing liquid refrigerant as lubricant to the at least one bearing assembly, the lubrication cycle having a steady state operation lubricating refrigerant supply line branched off from the condenser unit or from the economizer unit and to the at least one bearing assembly and connected to at least one injection device for introducing lubricating refrigerant from the condenser unit or from the economizer unit into the bearing assembly, and a vapor separating unit arranged in the steady state operation lubricating refrigerant supply line and adapted to separate gaseous phase lubricating refrigerant from liquid phase lubricating refrigerant;

a first pressure reduction device arranged in the steady state operation lubricating refrigerant supply line upstream of the vapor separating unit and adapted to reduce pressure of the lubricating refrigerant in the steady state operation lubricating refrigerant supply line; and a pressure regulating device arranged in the steady state operation lubricating refrigerant supply line downstream of the condenser unit and upstream of the first pressure reduction device.

19. A cooling system comprising:

a refrigerant cycle including at least a compressor unit for compressing gaseous refrigerant, a condenser unit for condensing gaseous refrigerant to liquid refrigerant, an optional economizer unit for reducing the pressure of the refrigerant and partially evaporating the liquid refrigerant, and an evaporator unit for evaporating the liquid refrigerant back to gaseous refrigerant, wherein the refrigerant is cycled from the compressor unit to the condenser unit, from the condenser unit to evaporator unit, optionally via the economizer unit, and from the evaporating unit back to the compressor unit, wherein the compressor unit includes at least one bearing assembly;

a lubrication cycle for providing liquid refrigerant as lubricant to the at least one bearing assembly, the lubrication cycle having a steady state operation lubricating refrigerant supply line branched off from the condenser unit or from the economizer unit and to the at least one bearing assembly and connected to at least one injection device for introducing lubricating refrigerant from the condenser unit or from the economizer unit into the bearing assembly, and a vapor separating unit arranged in the steady state operation lubricating refrigerant supply line and adapted to separate gaseous phase lubricating refrigerant from liquid phase lubricating refrigerant;

a first pressure reduction device arranged in the steady state operation lubricating refrigerant supply line upstream of the vapor separating unit and adapted to reduce pressure of the lubricating refrigerant in the steady state operation lubricating refrigerant supply line; and a second pressure reduction device arranged in the vapor recycling line downstream of the vapor separating unit and upstream of the evaporator unit, the second pressure reduction device being adapted to maintain a pressure level of the vapor separating unit to be more than 5% and less than 40% of a pressure difference between the condenser unit and the evaporator unit above the pressure level of the evaporator unit.

20. A cooling system comprising:

a refrigerant cycle including at least a compressor unit for compressing gaseous refrigerant, a condenser unit for condensing gaseous refrigerant to liquid refrigerant, an optional economizer unit for reducing the pressure of the refrigerant and partially evaporating the liquid refrigerant, and an evaporator unit for evaporating the liquid refrigerant back to gaseous refrigerant, wherein the refrigerant is cycled from the compressor unit to the condenser unit, from the condenser unit to evaporator unit, optionally via the economizer unit, and from the evaporating unit back to the compressor unit, wherein the compressor unit includes at least one bearing assembly;

a lubrication cycle for providing liquid refrigerant as lubricant to the at least one bearing assembly, the lubrication cycle having a steady state operation lubricating refrigerant supply line branched off from the condenser unit or from the economizer unit and to the at least one bearing assembly and connected to at least one injection device for introducing lubricating refrigerant from the condenser unit or from the economizer unit into the bearing assembly, and a vapor separating unit arranged in the steady state operation lubricating refrigerant supply line and adapted to separate gaseous phase lubricating refrigerant from liquid phase lubricating refrigerant;

a start-up lubricating refrigerant supply line connected to the evaporator unit and adapted to provide lubricating refrigerant from the evaporator unit to the at least one bearing assembly, the start-up lubricating refrigerant supply line merging with the steady state operation lubricating refrigerant supply line downstream of the vapor separating unit; and a three-way valve adapted to merge the start-up lubricating refrigerant supply line and the steady state operation lubricating refrigerant supply line, the three-way valve having a first inlet port connected to an upstream section of the steady state operation lubricating refrigerant supply line, which includes the vapor separating unit, a second inlet port connected to the start-up lubricating refrigerant supply line, and an outlet port connected to a downstream section of the steady state operation lubricating refrigerant supply line and adapted to guide lubricating refrigerant to the bearing assembly.

* * * * *